US010625982B2

(12) United States Patent
Haapaniemi et al.

(10) Patent No.: US 10,625,982 B2
(45) Date of Patent: Apr. 21, 2020

(54) ELEVATOR ARRANGEMENT WITH MULTIPLE CARS IN THE SAME SHAFT

(71) Applicants: Markku Haapaniemi, Helsinki (FI); Matti Rasanen, Hyvinkaa (FI); Markku Haivala, Hyvinkaa (FI); Jouni Ratia, Hyvinkaa (FI)

(72) Inventors: Markku Haapaniemi, Helsinki (FI); Matti Rasanen, Hyvinkaa (FI); Markku Haivala, Hyvinkaa (FI); Jouni Ratia, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 245 days.

(21) Appl. No.: 15/609,642

(22) Filed: May 31, 2017

(65) Prior Publication Data

US 2017/0267490 A1 Sep. 21, 2017

Related U.S. Application Data

(63) Continuation of application No. PCT/FI2014/050958, filed on Dec. 5, 2014.

(51) Int. Cl.
*B66B 11/00* (2006.01)
*B66B 19/00* (2006.01)

(52) U.S. Cl.
CPC ..... *B66B 11/0095* (2013.01); *B66B 11/005* (2013.01); *B66B 11/009* (2013.01); *B66B 11/0045* (2013.01); *B66B 11/0055* (2013.01); *B66B 11/00* (2013.01); *B66B 19/00* (2013.01)

(58) Field of Classification Search
CPC ..... B66B 11/0095; B66B 2009/006; B66B 11/0045; B66B 11/009
See application file for complete search history.

(56) References Cited

U.S. PATENT DOCUMENTS

| | | | | |
|---|---|---|---|---|
| 1,911,834 | A * | 5/1933 | Lindquist | B66B 9/00 187/249 |
| 5,419,414 | A | 5/1995 | Sakita | |
| 5,663,538 | A | 9/1997 | Sakita | |
| 8,011,480 | B2 | 9/2011 | Fischer | |
| 8,267,224 | B2 | 9/2012 | Gremaud et al. | |

(Continued)

FOREIGN PATENT DOCUMENTS

| | | |
|---|---|---|
| CN | 101903278 A | 12/2010 |
| JP | 2004155519 A | 6/2004 |

(Continued)

OTHER PUBLICATIONS

Machint Translation of JP 2006176286.*

(Continued)

*Primary Examiner* — Diem M Tran
(74) *Attorney, Agent, or Firm* — Harness, Dickey and Pierce, P.L.C.

(57) ABSTRACT

The invention relates to an elevator arrangement with multiple elevator cars in the same elevator shaft, the arrangement at least an uppermost elevator with its operating system, hoisting machinery and elevator car, and a lowermost elevator with its operating system, hoisting machinery and elevator car, which elevator cars are arranged to run in the same elevator shaft along the same guide rails. The types of the two elevators in the same elevator shaft are mutually different from each other.

12 Claims, 3 Drawing Sheets

(56) References Cited

U.S. PATENT DOCUMENTS

Figure 1:
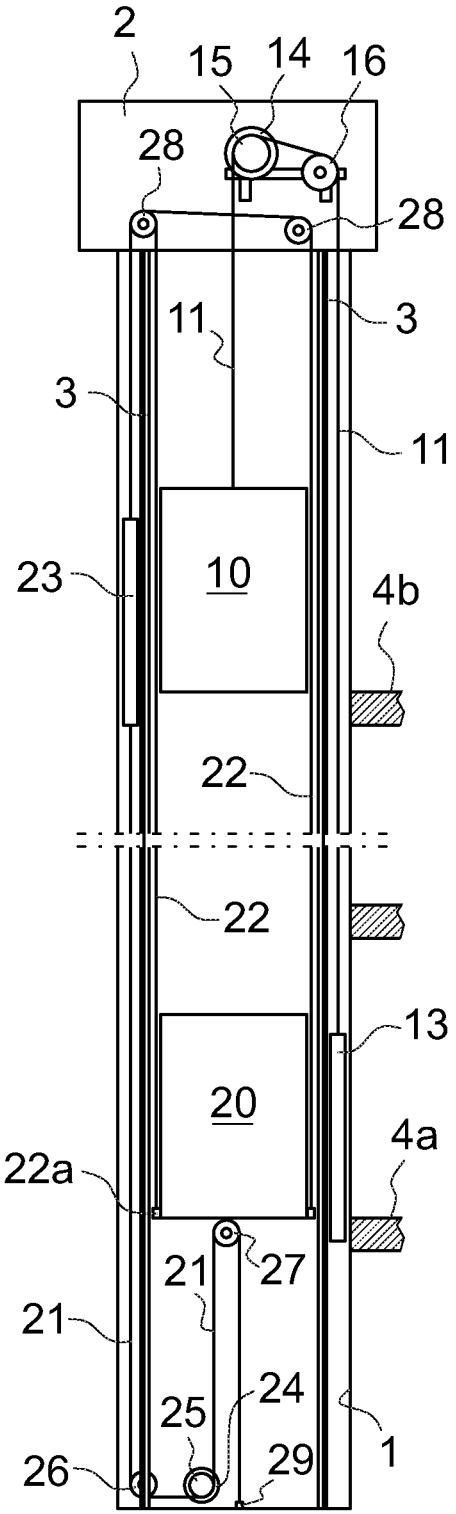

| | | | | |
|---|---|---|---|---|
| 8,651,241 | B2 | 2/2014 | Kocher | |
| 2008/0142310 | A1* | 6/2008 | Kocher | B66B 9/00 187/266 |
| 2008/0149426 | A1 | 6/2008 | Kocher | |
| 2008/0271954 | A1 | 11/2008 | Fischer | |
| 2010/0133046 | A1 | 6/2010 | Allwardt et al. | |
| 2010/0140022 | A1 | 6/2010 | Ach | |
| 2010/0187047 | A1 | 7/2010 | Gremaud et al. | |
| 2010/0243378 | A1 | 9/2010 | Begle | |
| 2011/0005867 | A1 | 1/2011 | Kocher | |
| 2011/0192683 | A1 | 8/2011 | Weinberger et al. | |
| 2014/0231179 | A1 | 8/2014 | Alasentie | |
| 2014/0291074 | A1 | 10/2014 | Bjorni et al. | |
| 2014/0332321 | A1 | 11/2014 | Begle | |
| 2015/0024891 | A1 | 1/2015 | Allwardt et al. | |
| 2016/0052748 | A1 | 2/2016 | Siikonen et al. | |
| 2016/0251202 | A1* | 9/2016 | Muller | B66B 11/0095 187/249 |

FOREIGN PATENT DOCUMENTS

| | | | | |
|---|---|---|---|---|
| JP | 2006-176286 | A | 7/2006 | |
| WO | WO-2006011634 | A1 * | 2/2006 | B66B 9/00 |
| WO | WO-2013110850 | A1 | 8/2013 | |

OTHER PUBLICATIONS

International Search Report PCT/ISA/210 for International Application No. PCT/FI/2014/050958 dated Sep. 1, 2015.

Written Opinion of the international Searching Authority PCT/ISA/237 for International Application No. PCT/FI2014/050958 dated Sep. 1, 2015.

Partial Chinese Office Action dated Jul. 16, 2018 for Chinese Patent Application No. CN 2014800838182.

Extended European Search Report dated Nov. 26, 2018 for EP Application No. 14907405.6.

* cited by examiner

ELEVATOR ARRANGEMENT WITH MULTIPLE CARS IN THE SAME SHAFT

This application is a continuation of PCT International Application No. PCT/FI2014/050958 which has an International filing date of Dec. 5, 2014, the entire contents of which are incorporated herein by reference.

The present invention relates to an elevator arrangement with multiple cars in the same shaft 1.

In prior art solutions elevators are usually provided with one car traveling up and down in a shaft. Because each car needs its own shaft the shafts for instance in a high-rise building require a lot of valuable space. For that reason the transportation capacity of the elevator systems has been tried to improve by installing two or more elevator cars in the same elevator shaft so that the cars travel one underneath another.

One solution according to prior art is shown in U.S. Pat. No. 5,419,414A. Particularly FIG. 2 of the US patent presents the structure of an elevator system where three elevator cars are installed one underneath another in the same elevator shaft. The cars are driven by the elevator motors which all are placed above the elevator shaft. Only a single hoisting rope fastened in the middle of the car roof is required between the uppermost or the first car and its counterweight. A term hoisting rope here in this description means usually a set of several parallel ropes that together form a bunch of ropes. The number of parallel ropes may be for example from two to eight. Because the second car is underneath the first car there is no room for the similar suspension as is with the first car. Now the hoisting ropes must pass the first car. In that case two separated hoisting ropes are used for the second car, these hoisting ropes being disposed on two different sides of the second car and running laterally outside the first car. The same kind of passing solution has been done also for the lowermost or the third car. However, now even four hoisting ropes are needed, two hoisting ropes on each side, in order to achieve symmetrical hoisting. The problem with this solution is the shortage of the space in the machine room and long driving shafts with two mutually separated traction sheaves for the two lowermost elevator cars. The shortage of space in the shaft may also lead to smaller elevator cars with their cross-section. Yet another problem is a complicated and time requiring installation that leads also to more expensive costs.

Another solution according to prior art is shown in U.S. Pat. No. 7,753,174B2. The patent presents the structure of an elevator system where two elevator cars are installed one underneath another in the same elevator shaft. The cars are driven by the two elevator motors which both are placed above the elevator shaft. Also in this case a single hoisting rope fastened in the middle of the car roof is required between the uppermost car and its counterweight. A term hoisting rope here means usually a set of several parallel ropes that together form a bunch of ropes. And two different hoisting ropes are used for the lowermost car, these hoisting ropes being disposed on two different sides of the lowermost car and running laterally outside the uppermost car. As to the using of space this solution has the same problems as the previous solution described above. Also a complicated and time requiring installation cause additional costs.

The object of the present invention is to eliminate the drawbacks described above and to achieve a reliable, easy to install, versatile and cost efficient elevator arrangement having a good transporting capacity with multiple cars in the same shaft. One object of the present invention is to achieve an elevator arrangement where the space in the elevator shaft can be utilized better than in earlier solutions so that total cross-sectional areas of elevator cars can be made bigger in same size of the elevator shafts. Yet a further object of the present invention is to achieve an elevator arrangement where elevator cars can be moved later to serve new floors when floors are built or when new floors are taken for new use.

According to the invention at least two elevators have their elevator cars travelling in the common elevator shaft. The uppermost of the elevators have an elevator car travelling above all the other elevator cars and the lowermost of the elevators have an elevator car travelling below all the other elevator cars. Preferably two elevators cars travel in the elevator shaft. The types of two elevators in the common elevator shaft differ from each other. Preferably one of the elevators has its hoisting machinery in or near the top of the elevator shaft and other one has its hoisting machinery in or near the pit of the elevator shaft. Near the elevator shaft means in this context a machinery location in a machine room or machine space near or adjacent to the elevator shaft. The distinction between the elevator types could be also of other kind, for example the first one of the elevators is suspended and/or driven by aid of steel wire ropes and the second one of the elevators is suspended and/or driven by aid of belts or flat ropes. A possible arrangement according to the invention is such that one of the elevators is a linear motor elevator and other one is a traction sheave elevator.

The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

The elevator arrangement according to the invention has the advantage among other things that it saves space in the machine room and/or in the elevator shaft. That makes it possible to use bigger elevator cars than earlier in the same shaft where at least two cars are installed one underneath the other in the same shaft. The arrangement according to the invention makes it also possible to install two or more elevator cars in higher elevator shafts than earlier. One more advantage is that the lowermost elevator car can be installed afterwards without disturbing the uppermost elevator car. Further an advantage is that lowermost elevator car can act as a jump lift when the building is under construction, and the final elevator car can be installed later when the building is high enough. After that the lowermost elevator car can serve for example for the whole building or only for the lowermost floors. Having both the lowermost and the uppermost elevator in operation, preferably the both elevators serve at least one of the lowermost floors. A suitable utilization of the invention is such that all the floors being along the common travel of the both elevators are served by both the lowermost and the uppermost elevator.

Figure 2:
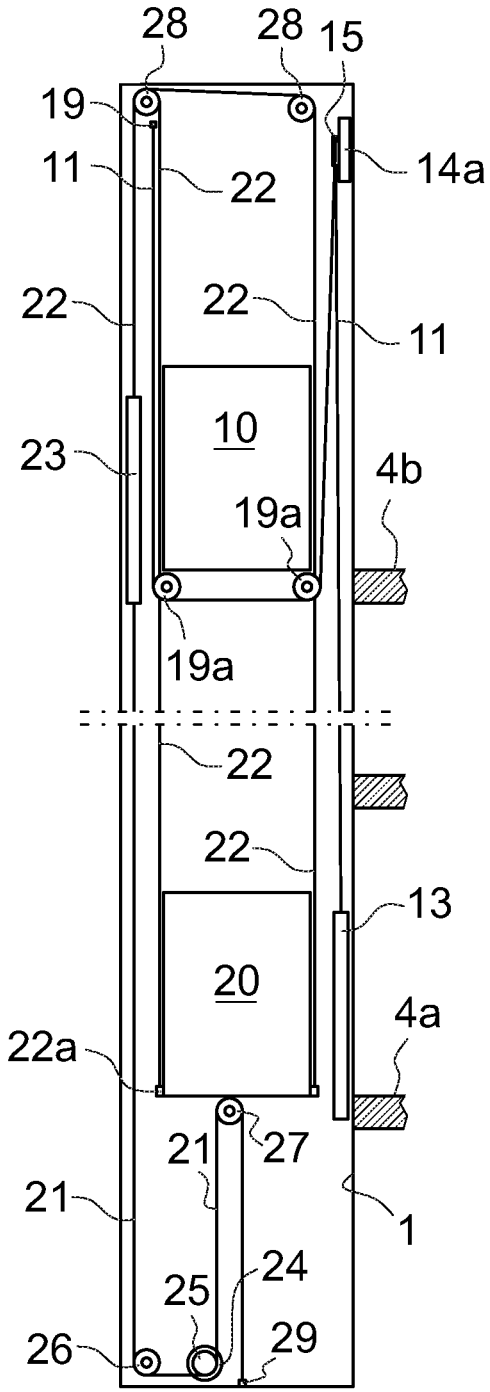
Figure 3:
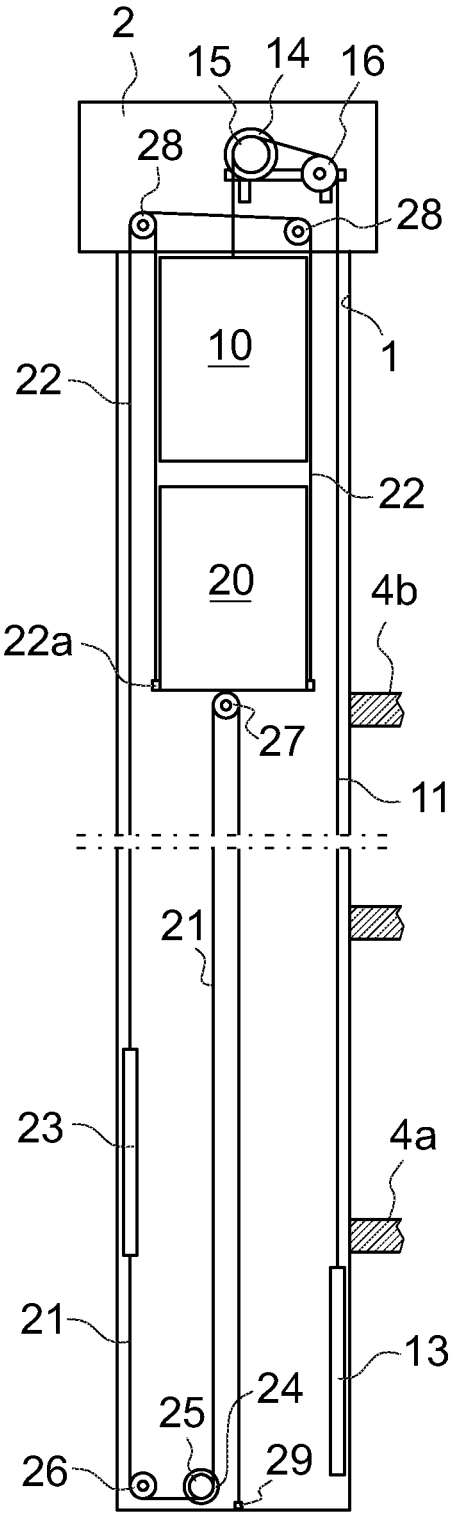
Figure 4:
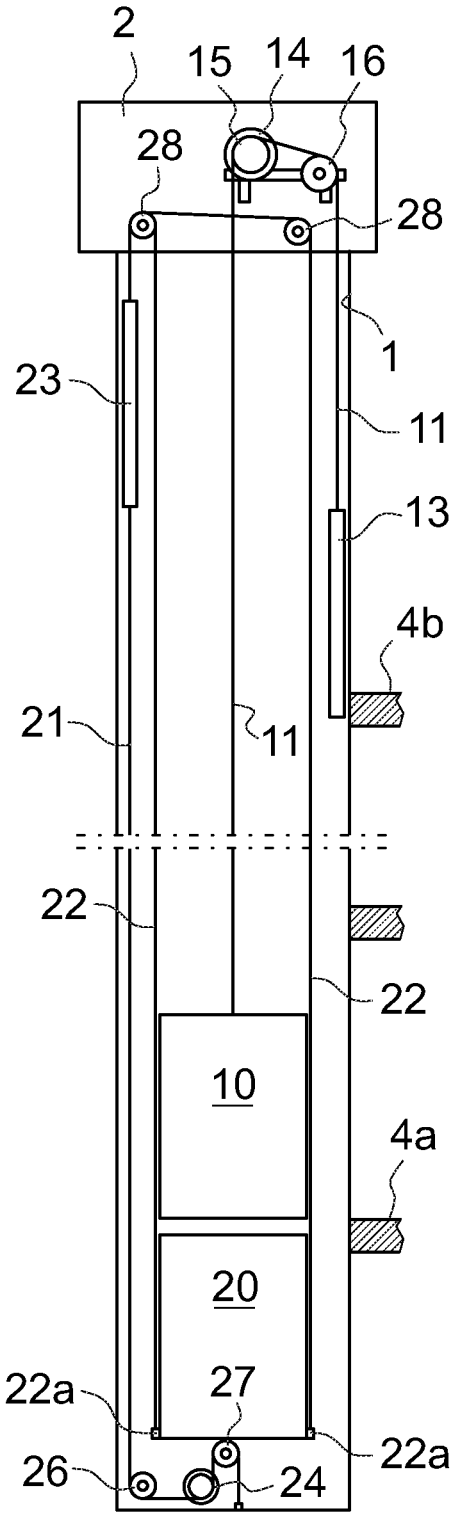
Figure 5:
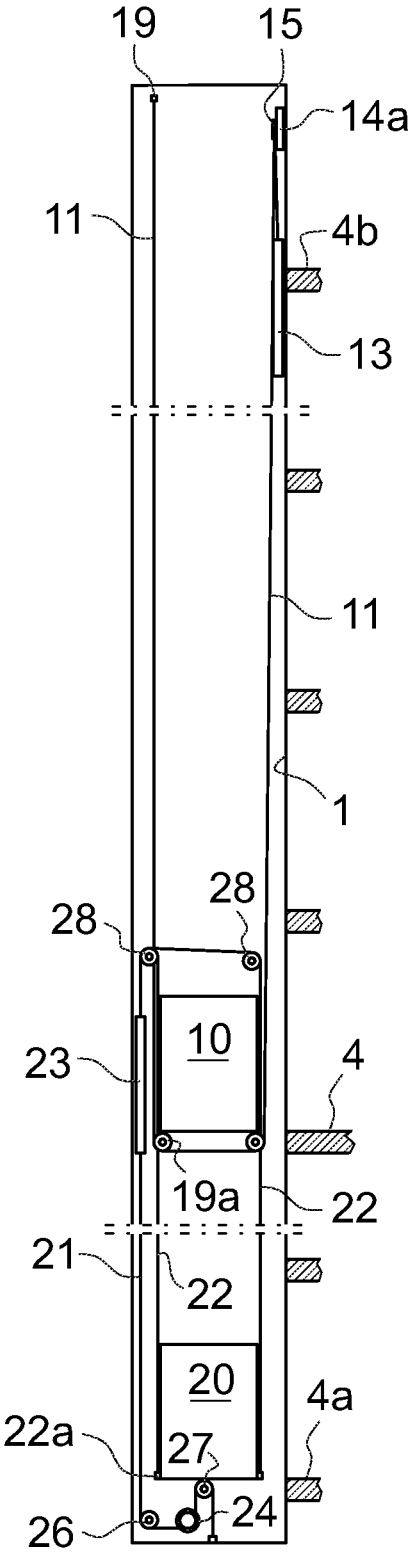
Figure 6:
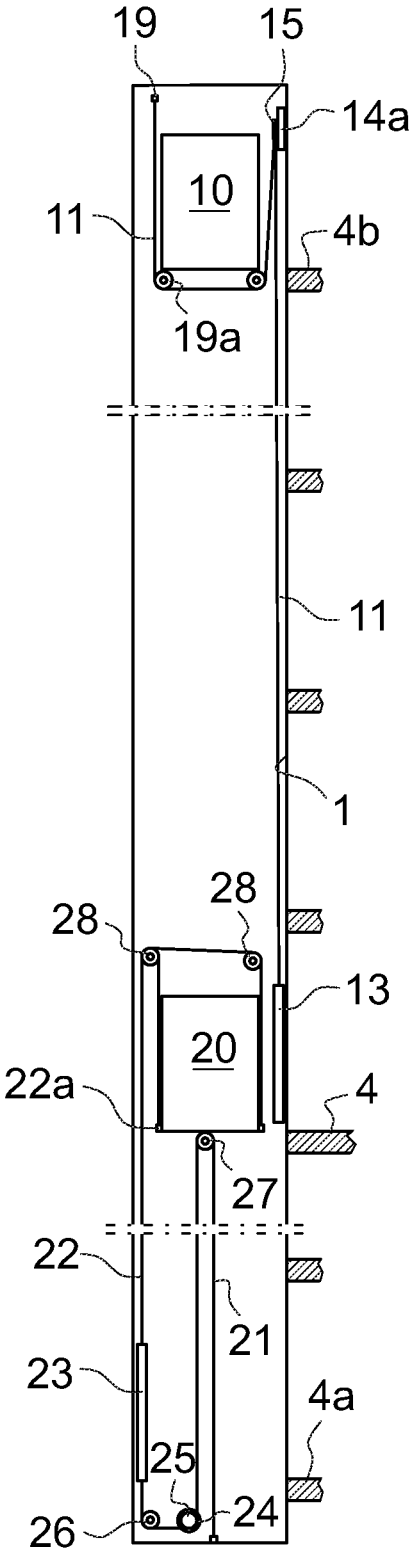

In the following, the invention will be described in detail by the aid of an example by referring to the attached simplified and diagrammatic drawings, wherein FIG. 1 presents in a simplified and diagrammatic front view an elevator arrangement according to the invention with two elevator cars in the same shaft, FIG. 2 presents in a simplified and diagrammatic front view another elevator arrangement according to the invention with two elevator cars in the same shaft, FIG. 3 presents in a simplified and diagrammatic front view an elevator arrangement according to FIG. 1 where both the elevator cars are in the upper part of the same shaft, FIG. 4 presents in a simplified and diagrammatic front view an elevator arrangement according to FIG. 1 where both the elevator cars are in the lower part of the same shaft, FIG. 5 presents in a simplified and diagrammatic front view yet another elevator arrangement according to the invention with two elevator cars at their lowermost positions in the same shaft, and FIG. 6 presents in a simplified and diagrammatic front view an elevator arrangement according to FIG. 5 with two elevator cars at their uppermost positions in the same shaft.

It is essential to the solution according to the invention that there are at least two elevator cars running in the same elevator shaft, and that the uppermost elevator car is driven by a hoisting machinery that is above the elevator shaft or at least at an upper part of the elevator shaft, and the lowermost elevator car is driven by a hoisting machinery that is underneath the lowermost elevator car.

FIG. 1 presents in a simplified and diagrammatic front view an elevator arrangement according to the invention with two elevator cars 10 and 20 running in the same elevator shaft 1. The first or the uppermost elevator car 10 is driven by a first hoisting machinery 14 equipped with a traction sheave 15 and a diverting pulley 16. In this example the hoisting machinery 14 is placed in a separate machine room 2 above the elevator shaft 1 but it could as well be placed also at the upper part of the elevator shaft 1. A hoisting rope 11 is installed between the first elevator car 10 and its counterweight 13 that can also be a compensating weight. The hoisting rope 11 in all embodiments of the invention can be a single rope or a bunch of similar parallel ropes. A first end of the hoisting rope 11 is secured at the upper part of the uppermost elevator car 10 and from the elevator car 10 the hoisting rope 11 is passed around and over the traction sheave 15 of the first hoisting machinery 14, and from the traction sheave 15 the hoisting rope 11 is further passed over the diverting pulley 16 to a first counterweight 13. The suspension ratio in the suspension like this is 1:1. The uppermost elevator car 10 is arranged to run through the whole elevator shaft 1 from the lowermost floor level 4*a* to the uppermost floor level 4*b* and vice versa.

The second or the lowermost elevator car 20 is driven by a second hoisting machinery 24 equipped with a drive wheel 25. In this example the second hoisting machinery 24 is placed in the lower part of the elevator shaft 1 below the second elevator car 20. First ends of the two suspension ropes 22 have been secured at the lower part of the lowermost elevator car 20 each end at its own side of the lowermost elevator car 20 where fastening points 22*a* are situated. Instead of the lower part the fastening points 22*a* can be situated at any height of the lowermost elevator car 20. From the fastening points 22*a* the suspension ropes 22 are passed around and over the diverting pulleys 28 that are placed in the machine room 2 or at the upper part of the elevator shaft 1 so high that the lowermost elevator car 20 can be landed at the uppermost floor lever 4*b* of the elevator shaft 1. And finally from the diverting pulleys 28 the suspension ropes 22 are led to a second counterweight 23 that can also be a compensating weight.

The supporting and moving of the lowermost elevator car 20 are separated from each other. The arrangement comprises a separate traction member 21 that is connected between the second counterweight 23 and the second elevator car 20. The traction member 21 can be a single member or a bunch of similar parallel members, for instance the traction member 21 can be a toothed belt, chain or other type of member that does not slip on the drive wheel 25.

A first end of the traction member 21 is secured in its fastening point 29 at the bottom of the elevator shaft 1 or at another appropriate place at the lower part of the elevator shaft 1. From the fastening point 29 the traction member 21 is passed around and over the diverting pulley 27 that is placed at the lower part of the elevator car 20 and from the diverting pulley 27 the traction member 21 is passed under the drive sheave 25 of the second hoisting machinery 24, and from the drive sheave 25 the traction member 21 is further passed under a diverting pulley 26 to the second counterweight 23 where a second end of the traction member 21 is secured to the second counterweight 23. The suspension ratio in the suspension like this is 2:1. The lowermost elevator car 20 is also arranged to run through the whole elevator shaft 1 from the lowermost floor level 4*a* to the uppermost floor level 4*b* and vice versa.

FIG. 2 presents in a simplified and diagrammatic front view another elevator arrangement according to the invention with two elevator cars 10 and 20 running in the same elevator shaft 1. The concept of the elevator with two elevator cars 10, 20 is basically the same as in FIG. 1 but now the machine room is not needed because the hoisting machinery 14*a* of the uppermost elevator car 10 is placed at the upper part of the elevator shaft 1. In this arrangement the first end of the hoisting rope 11 for the first elevator car 10 is secured at the upper part of the elevator shaft 1 and from the fastening point 19 of the first end of the hoisting rope 11 the hoisting rope 11 is passed to and under diverting pulleys 19*a* connected with the elevator car 10, and further the hoisting rope 11 is led around and over the traction sheave 15 of the hoisting machinery 14*a* that is installed at the upper part of the elevator shaft 1, for instance to the guide rail 3 or to the wall of the elevator shaft 1. From the traction sheave 15 the hoisting rope 11 is further passed to the first counterweight 13. The suspension ratio in the suspension like this is 2:1. Also in this arrangement the uppermost elevator car 10 is arranged to run through the whole elevator shaft 1 from the lowermost floor level 4*a* to the uppermost floor level 4*b* and vice versa.

The suspension arrangement of the lowermost elevator car 20 is otherwise similar with the lowermost elevator car 20 assembly of FIG. 1 but now the diverting pulleys 28 are at the upper part of the elevator shaft 1, and preferably so high above the uppermost floor level 4*b* that the lowermost elevator car 20 can also land to the uppermost floor level 4*b* so that the uppermost elevator car 10 is then just above the lowermost elevator car 20 and below the diverting pulleys 28.

In the arrangements of FIGS. 1 and 2 both the elevator cars 10, 20 are running along the same guide rails 3 that are presented only in FIG. 1. The counterweights or compensating weights 13, 23 are running in their own guide rails that are not presented in the schematic figures. The control system of the elevator group has been arranged so that the elevator cars 10, 20 can move freely in the elevator shaft 1 without colliding each other.

FIGS. 3 and 4 show the elevator cars 10 and 20 of the elevator arrangement according to FIG. 1 in different positions in the same elevator shaft 1. In FIG. 3 both the elevator cars 10 and 20 are in the upper part of the same elevator shaft 1, and the lowermost elevator car 20 is on the uppermost floor level 4*b*, and the uppermost elevator car 10 is above the lowermost elevator car 20 in the upper space of the shaft 1 above the uppermost floor level 4*b*. Whereas in FIG. 4 both the elevator cars 10 and 20 are in the lower part of the same shaft 1, and the uppermost elevator car 10 is on the lowermost floor level 4*a*, and the lowermost elevator car 20 is below the uppermost elevator car 10 in the lower space of the shaft 1 below the lowermost floor level 4*a*. So the upper space and lower space of the elevator shaft 1 are made so high that one elevator car can be parked to that space when the other elevator car lands either to the lowermost floor level 4*a* or the uppermost floor level 4*b*.

FIGS. 5 and 6 show yet another elevator arrangement according to the invention with two elevator cars 10, 20 in the same elevator shaft 1. In FIG. 5 the two elevator cars 10, 20 are at their lowermost positions in the same shaft 1 and in FIG. 6 the two elevator cars 10, 20 are at their uppermost positions in the same shaft 1.

In this arrangement the uppermost elevator car 10 is suspended in the similar way as the uppermost elevator car 10 of FIG. 2. The hoisting machinery 14*a* with its traction sheave 15 is placed at the upper part of the elevator shaft 1 and the uppermost elevator car 10 is arranged to run from the basement floor 4 to the uppermost floor 4*b* and vice versa. The lowermost elevator car 20 is suspended also in the similar way as the lowermost elevator car 20 of FIG. 2. Only difference is now the fact that the diverting pulleys 28 are not at the upper part of the elevator shaft 1 but are placed in the elevator shaft 1 at the height where the lowermost elevator car 20 can run from the lowermost floor 4*a* at highest to the basement floor 4 and vice versa. So, the only floor level in common for both the elevator cars 10, 20 is the basement floor 4. The diverting pulleys 28 are placed so that the uppermost elevator car 10 can pass them.

The arrangement mentioned above can be for instance in a building where the upper floors are for offices, shops or residential purposes and the lower floors are for parking. The ground floor can be for instance the basement floor 4. As well, the diverting pulleys 28 for the lowermost elevator car 20 can also be higher than just on the basement floor 4. They can be at any height of the building depending on the purpose of the use of the lowermost elevator car 20.

The lowermost elevator can be the first elevator in the elevator shaft 1 and the uppermost elevator can be assembled later. For instance the lowermost elevator can act as a jump lift when the building is under construction, and the uppermost elevator can be installed as a final elevator later when the building is high enough. The uppermost elevator can be installed also by using the lowermost elevator as an assembly stand.

According to the invention the uppermost elevator is a traction sheave elevator and the lowermost elevator is another type of an elevator, for instance an elevator where supporting and moving has been separated from each other. Then the traction member 21 is for instance a toothed belt, chain or other type of member that does not slip on the drive wheel 25. Two different types of elevators in the same shaft 1 make it possible to better utilize all the spaces in the elevator shaft 1.

It is obvious to the person skilled in the art that the invention is not restricted to the example described above but that it may be varied within the scope of the claims presented below.

The invention claimed is:

1. An elevator arrangement with multiple elevator cars in an elevator shaft, the elevator arrangement comprising:

an uppermost elevator including a first control system, first hoisting machinery and a first elevator car, the first hoisting machinery including a hoisting rope connected between a top of the first elevator car and a first counterweight via a traction sheave, the hoisting rope configured to both suspend and move the first elevator car in the elevator shaft between a lowermost floor and an uppermost floor, and a lowermost elevator including a second control system, second hoisting machinery and a second elevator car, the second hoisting machinery including suspension ropes and a traction member, the suspension ropes configured to suspend the second elevator car via diverting pulleys above the first elevator car and the traction member connected between a bottom of the second elevator car and a second counterweight via a drive wheel below the second elevator car to move the second elevator car in the elevator shaft between the lowermost floor and the uppermost floor such that the first elevator car and the second elevator car run along same guide rails while the first elevator car and the second elevator car utilize different types of suspension systems.

2. The elevator arrangement according to claim 1, wherein the first hoisting machinery is above the elevator shaft or at least at an upper part of the elevator shaft, and the second hoisting machinery is below the second elevator car.

3. The elevator arrangement according to claim 1, wherein traction member is one of a toothed belt and chain configured not to slip on the drive wheel of the second hoisting machinery.

4. The elevator arrangement according to claim 1, wherein diverting pulleys supporting the second elevator car are in the elevator shaft or above the elevator shaft.

5. The elevator arrangement according to claim 1, wherein the second elevator car is configured to act as a jump lift when a building associated with the elevator shaft is under construction, and/or as an assembly stand when installing the first elevator car.

6. The elevator arrangement according to claim 1, wherein the lowermost floor is served by both the first elevator car and the second elevator car.

7. An elevator comprising:

elevator cars configured to move on same guide rails in an elevator shaft, the elevator cars including a first elevator car arranged above a second elevator car with respect to a bottom of the elevator shaft, the first elevator car and the second elevator car connected to first hoisting machinery and second hoisting machinery, respectively, wherein the first hoisting machinery including a traction sheave connected to a top of the first elevator car and a first counterweight via a hoisting rope, the traction sheave configured to support the first elevator car, and the second hoisting machinery including diverting pulleys above the first elevator car in the elevator shaft and a drive wheel below the second elevator car, the drive wheel connected to a bottom of the second elevator car and a second counterweight via a traction member such that the second elevator car is supported by the diverting pulleys and moves in response to movement of the drive wheel.

8. The elevator of claim 7, wherein the first hoisting machinery is above the first elevator car and the second hoisting machinery is below the first elevator car with respect to the bottom of the elevator shaft.

9. The elevator of claim 8, wherein the second hoisting machinery is below the second elevator car with respect to the bottom of the elevator shaft.

10. The elevator of claim 7, wherein the traction sheave is configured to move the hoisting rope connected between the top of the first elevator car and a first counterweight, and the drive wheel is configured to move the traction member connected between a bottom of the elevator shaft and a bottom of a second counterweight such that a portion of the traction member therebetween runs along the drive wheel.

11. The elevator of claim 7, wherein the first elevator car and the second elevator car are a highest most and lowest most elevator car in the elevator shaft, respectively.

12. The elevator of claim 7, wherein a suspension ratio of the second elevator car is a 2:1 suspension ratio such that the second elevator car is not suspended via hosting ropes passing sides of the first elevator car.

* * * * *